US005561410A

United States Patent [19]

Toki

[11] Patent Number: 5,561,410

[45] Date of Patent: Oct. 1, 1996

[54] MULTI-LAYER COIL USING ELECTROCONDUCTIVE FLEXIBLE SHEETS

[75] Inventor: Nozomi Toki, Tokyo, Japan

[73] Assignee: NEC Corporation, Tokyo, Japan

[21] Appl. No.: 354,152

[22] Filed: Dec. 6, 1994

[30] Foreign Application Priority Data

Dec. 13, 1993 [JP] Japan ..... 5-311593

[51] Int. Cl.[6] ..... H01F 27/28

[52] U.S. Cl. ..... 336/200; 336/206; 336/223

[58] Field of Search ..... 336/200, 205, 336/206, 223, 180

[56] References Cited

U.S. PATENT DOCUMENTS

| | | | |
|---|---|---|---|
| 2,703,854 | 3/1955 | Eisler | 336/200 |
| 3,102,245 | 8/1963 | Lawson, Jr. | 336/205 |
| 4,847,984 | 7/1989 | Rossi et al. | 336/200 |

FOREIGN PATENT DOCUMENTS

| | | | |
|---|---|---|---|
| 58-53806 | 3/1983 | Japan | 336/200 |
| 59192803 | 12/1984 | Japan . | |
| 1-187907 | 7/1989 | Japan | 336/225 |

OTHER PUBLICATIONS

IBM Technical Bulletin, vol. 16, No. 9, Feb. 1974, Gonnella et al., p. 3008, 336–200, "Flexible Circuit Solenoid".

IBM Technical Bulletin, vol. 12, No. 6, Nov. 1969, Moreno p. 778, "Printed Circuit Coil," 336–200.

*Primary Examiner*—Thomas J. Kozma
*Attorney, Agent, or Firm*—Whitham, Curtis, Whitham & McGinn

[57] ABSTRACT

Insulating flexible sheets and electroconductive flexible sheets having electroconductive patterns are stacked alternately into a multi-layer structure to form a laminated body. The inclining directions of the obliquely formed electroconductive patterns are varied alternately from layer to layer, and the patterns of different layers are electrically connected by electro-conductive connecting parts formed on the insulating sheets. A pattern of a single line wound in the same direction is formed by rounding the laminated body so as to connect the patterns to each other and thereby form a cylindrical multi-layer coil. Further, by opening the connecting part to make it a tapping part and reducing the number of turns of the multi-layer coil, the inductance of the coil can be set as desired. Alternatively the electroconductive patterns are formed with the same inclination and the connecting part on each insulating flexible sheet is opened to make it a tapping part, so that each layer constitutes an independent single-layer coil. This plurality of single-layer coils are freely connected whether in series or in parallel.

3 Claims, 4 Drawing Sheets

MULTI-LAYER COIL USING ELECTROCONDUCTIVE FLEXIBLE SHEETS

BACKGROUND OF THE INVENTION

The present invention relates to a multi-layer coil, and more particularly to a multi-layer coil using electro-condutive flexible sheets having electroconductive patterns.

Multi-layer coils have been used as voice coils for dynamic speakers and high frequency coils for radio communication apparatuses.

Coils using electroconductive flexible sheets are used with a view to simplifying the process to wind the conductor around a bobbin or a core. Furthermore, such coils are used with a view to preventing the precision of inductance from being deteriorated by unevenness of the winding pitch.

A coil using electroconductive flexible sheets, such as mentioned above, is described for instance in the Japanese utility model application laid-open Showa 59-192803, disclosed on Dec. 21, 1984.

In the utility model application,a conductor is formed over the flexible sheet, and this conductor corresponds to a coil of leading wire.

The conductor is formed over the flexible sheet so as to constitute a single continuous conductor when the flexible sheet is rounded into a cylindrical shape. The conductor over the flexible sheet is jointed. Therefore, when the flexible sheet is rounded, the conductor forms a single leading wire wound in the same direction to constitute a coil.

However, a coil described in the utility model application cannot be used as a voice coil for dynamic speakers or a high frequency coil for radio communication apparatuses. Thus, this coil involves the problem of not permitting a multi-layer structure because of its single-layer structure.

Furthermore, though it is conceivable to increase the number of single-layer windings to compose a high frequency coil, the space to accommodate the coils restricts the number of windings in such an attempt, resulting in the problem that no sufficient power to drive dynamic speakers could be derived.

SUMMARY OF THE INVENTION

An object of the present invention, therefore, is to provide a multi-layer coil using electroconductive flexible sheets, which is reduced in size but capable of supplying sufficient driving power.

Another object of the invention is to provide a multi-layer coil using electroconductive flexible sheets, which permits the inductance of the coil to be freely set as desired.

Still another object of the invention is to provide a multi-layer coil using electroconductive flexible sheets, which permits free connection of a plurality of independent single-layer coils whether in weries or in parallel.

In order to achieve the above-stated objects, in a multi-layer coil according to the invention, insulating flexible sheets and electroconductive flexible sheets, each having electroconductive patterns of foils, are stacked alternately to form a laminated body, and the inclining direction of the electroconductive patterns is varied alternately, layer by layer. On each of the insulating flexible sheets a connective part is formed for electrically connecting pattern layers. The flexible sheets are laminated so that all the patterns constitute a single line wound in the same direction and rounded to form a cylindrical coil.

Further, in a multi-layer coil according to the invention, the connective part on each insulating flexible sheet may be formed as a throughhole or land structure, and allowed to be short-circuited or opened as desired. By opening the connecting part to make it a tapping part and reducing the number of turns of the multi-layer coil, the inductance of the coil can be set as desired.

Furthermore, in a multi-layer coil according to the invention, the laminated body may be so formed that every layer of electroconductive flexible sheet has the same inclination of the electroconductive patterns formed on it. The connecting part on each insulating flexible sheet may be opened to make it a tapping part so that each layer constitutes an independent single-layer coil, and this plurality of single-layer coils may be freely connected whether in series or in parallel.

BRIEF DESCRIPTION OF THE DRAWINGS

These and other objects, features and advantages of the present invention will become more apparent from the following detailed description when taken in conjunction with the accompanying drawings, wherein.

DETAILED DESCRIPTION OF THE PREFERRED EMBODIMENT

Figure 1:
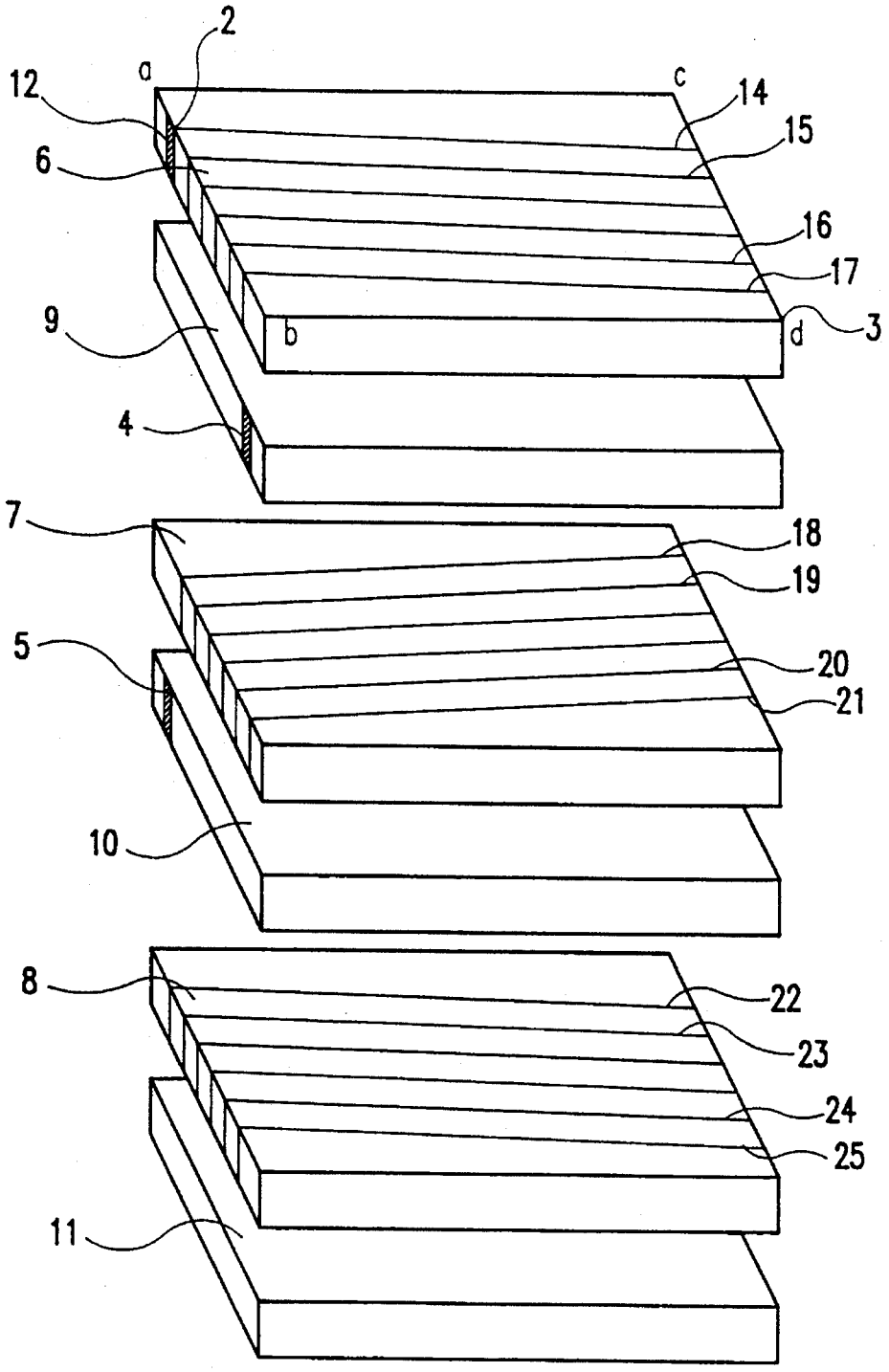
FIG. 1 shows a perspective view of electroconductive flexible sheets and insulating flexible sheets.

Referring to FIG. 1, in a pattern layer 6, which is an electroconductive flexible sheet, electroconductive patterns 14, 15, 16 and 17 of copper foils are formed over the main surface and end faces of an insulating flexible sheet.

Similarly in pattern layers 7 and 8, electroconductive patterns 18 through 21 and 22 through 25 are formed, respectively.

These electroconductive patterns are formed obliquely with respect to the pattern layers, and the pattern layers 6 and 8 have the same including direction while the pattern layer 7 have a inclining direction inverse to them.

The pattern layers are so stacked that the inclining direction alternately changes via the insulating layers. This arrangement is intended to connect, when a cylindrical coil is formed, one end of the electroconductive pattern 14, for instance, to the opposite end of the next electroconductive pattern 15 and so forth to constitute a single conductor.

Further in the pattern layer 6 is formed a tapping part 12, corresponding to the winding start part of the coil and a tap line is connected to this tapping part 12 after a cylindrical coil is formed as will be described below. Meanwhile, insulating layers 9, 10 and 11 includes insulating flexible sheets, and on the insulating layers 9 and 10 are formed connecting parts 4 and 5. These connecting parts are intended to electrically connect electroconductive patterns between the pattern layers when the cylindrical coil is formed. The connecting part 4 electrically connects the electroconductive pattern 17 on the pattern layer 6 and the electroconductive pattern 21 on the pattern layer 7. In the same way,the connecting part 5 electrically connects the electroconductive pattern 18 on the pattern layer 7 and the electroconductive pattern 22 on the pattern layer 8.

Figure 4:
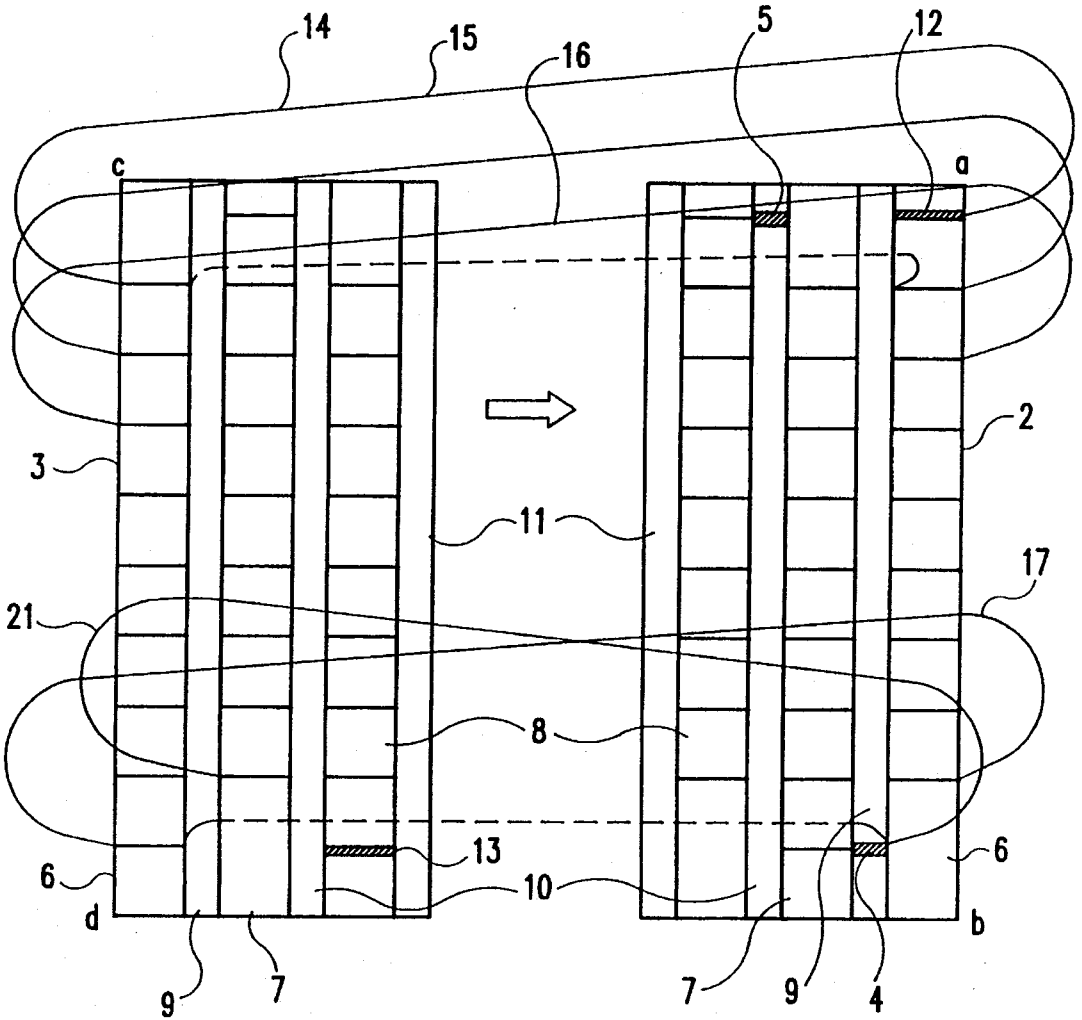
FIG. 4 shows a front view of the connection of electroconductive patterns of the multi-layer coil.

Referring to FIG. 4, a tapping part 13 corresponds to the winding end part of the coil, and consists of a conductor.

Figure 2:
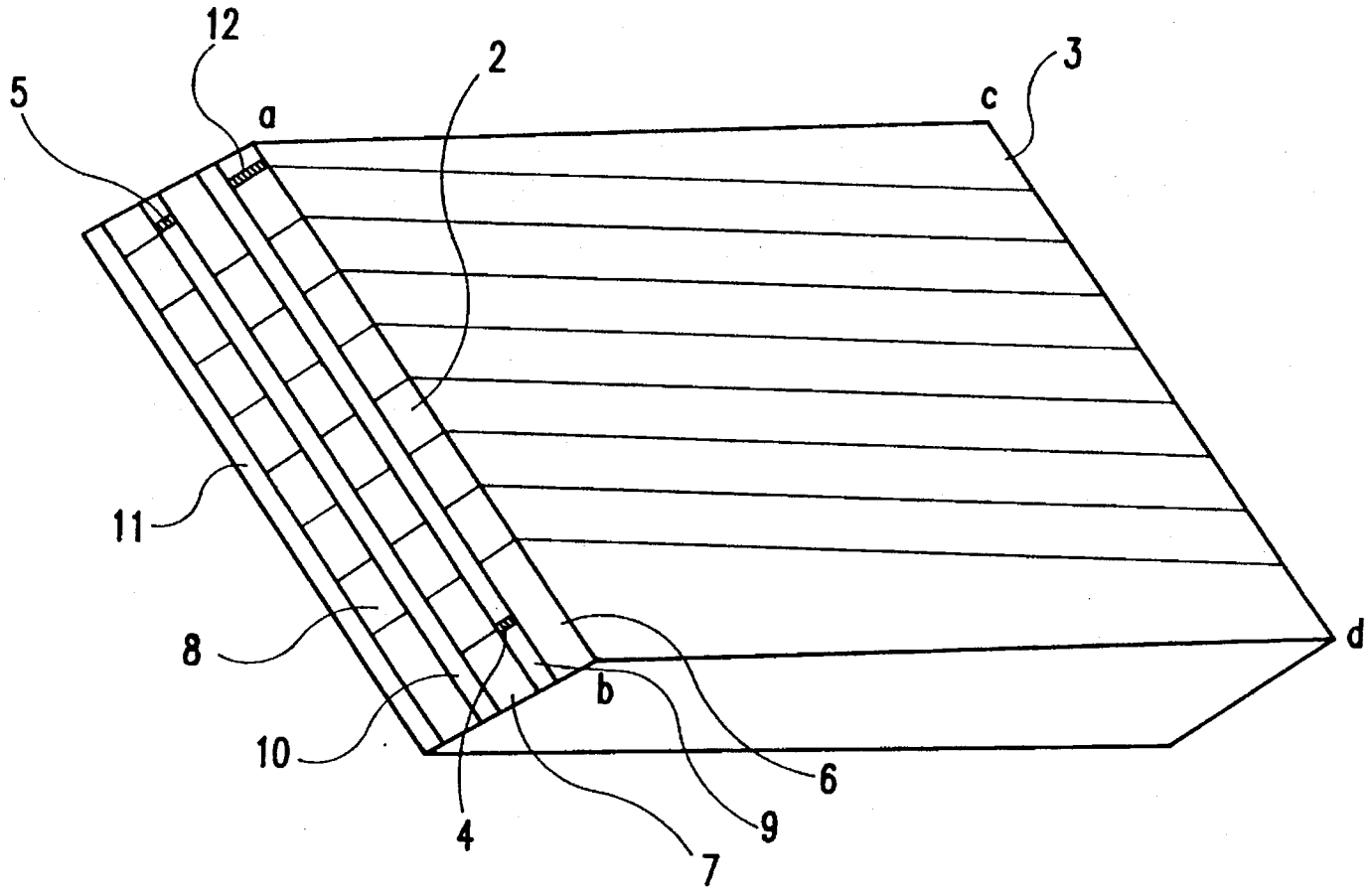
FIG. 2 shows a perspective view of a laminated body in which electroconductive flexible sheets and insulating flexible sheets are stacked one over another.

The six sheets described above are stacked and bonded together with an adhesive to form a laminated body illustrated in FIG. 2.

Referring to FIG. 2, the laminated body comprises the insulating layers 9 through 11 and electroconductive sheets having electroconductive patterns 6 to 8 of copper foils. The insulating layers 9–11 and electroconductive sheets are stacked alternately to form the laminated body.

Since the electroconductive sheets are stacked in multiple layers with the insulating sheets in-between, no two electroconductive patterns come into contact with each other and are prevented from being.

Figure 3:
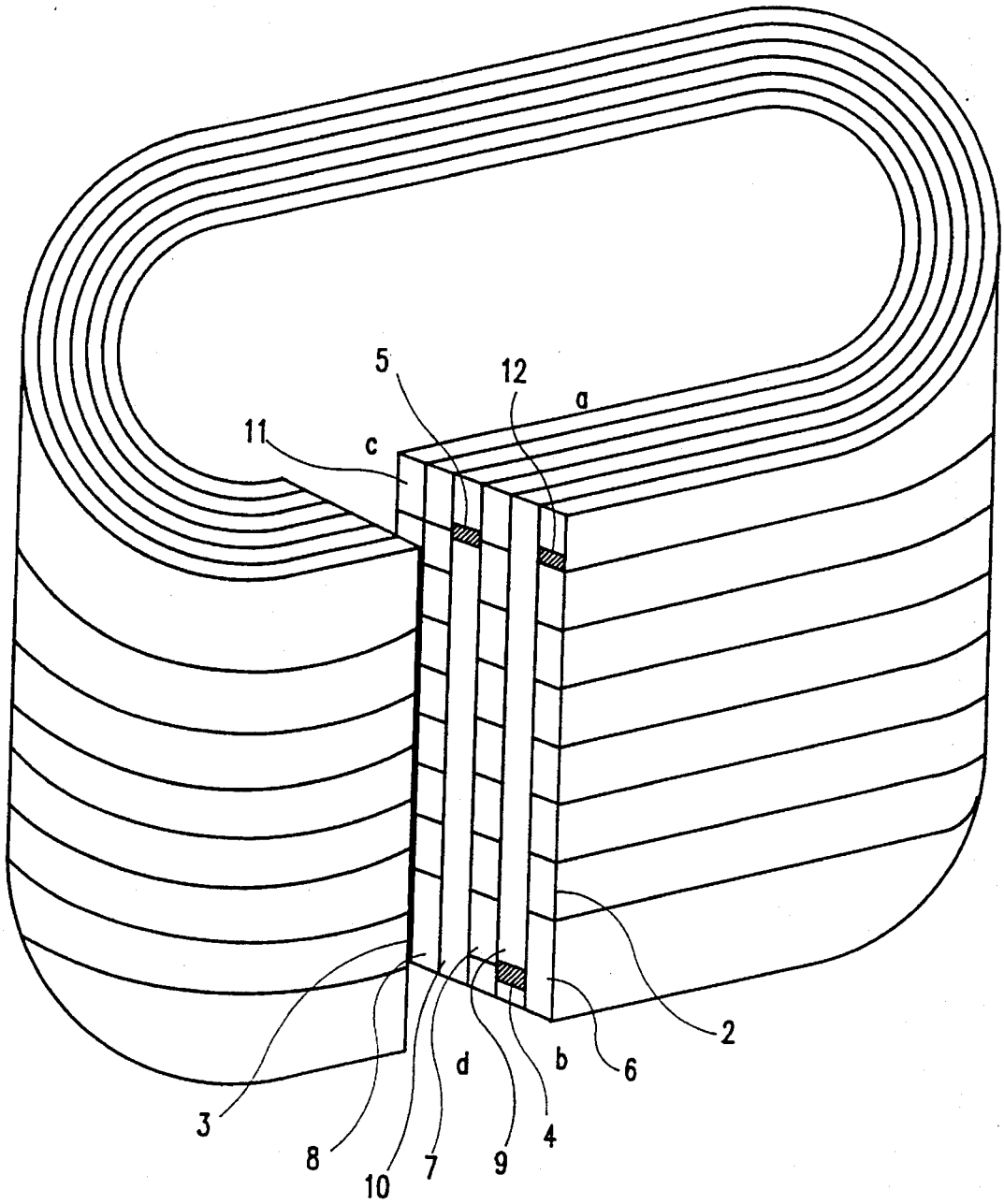
FIG. 3 shows a perspective view of the preferred embodiment of the invention.

This laminated body is rounded to form a cylindrical coil as illustrated in FIG. 3.

In FIG. 3, the electroconductive patterns of the pattern layers constitute a single multi-layer coil beginning at the tapping part 12 and ending at the tapping part 13.

The end faces a-b and c-d, i.e. 2 and 3, of the laminated body of the triple-layer structure electrically connect, for instance, the electroconductive patterns 14 and 15 shown in FIG. 1 and other mutually corresponding electroconductive patterns.

For these connections is used an electroconductive adhesive. Referring again to FIG. 4, the connection of the patterns begins at the tapping part 12. First, the electroconductive pattern 14 of the pattern layer 6 of the first layer is connected to the electroconductive pattern 15 as indicated by a dotted line in the diagram, and the other electroconductive patterns on the pattern layer 6 are similarly connected from top to bottom. The lowest electroconductive pattern 17 on the pattern layer 6 is connected to the lowest pattern 21 on the second pattern layer 7 via the connecting part 4 of the insulating layer 9 as indicated by another dotted line in the diagram. The patterns on the pattern layer 7 are connected in the inverse order to those on the first pattern layer 6, i.e. from bottom to top. The top electroconductive pattern on the pattern layer 7 and that on the third pattern layer 8 are connected via the connecting part 5 of the insulating layer 10. The electroconductive patterns on the pattern layer 8 are connected in the same order as those on the pattern layer 6, i.e. from top to bottom, and reaches the tapping part 13.

Therefore, if the laminated body composed by stacking the pattern layers and the insulating layers is rounded to form a cylindrical coil, the electroconductive patterns of the pattern layers will constitute a single conductor to provide a multi-layer coil. Incidentally, the number of electroconductive flexible sheets is determined by the inductance of the coil.

Next will be described a first adaptation of the present invention, in which the electroconductive connecting parts 4 and 5 can be formed as throughhole or land structures to freely permit short circuiting and opening.

In this configuration, if a connecting part is opened to be made a tapping part, a smaller number of turns will be required for the multi-layer coil than in the above-described first preferred embodiment.

Referring to FIG. 4, if the connecting part 4, for instance, is made a tapping part, the number of turns required for the multi-layer coil will be made smaller than in the case where a tap line is derived from the tapping part 13 as in the first embodiment, resulting in a lower inductance of the coil.

Therefore, the inductance of the coil can be varied as desired by using any selected connecting part on an insulating layer as the tapping part and deriving a tap line therefrom.

For a second adaptation of the invention can be adopted a configuration in which, instead of alternating the inclining directions of the electroconductive patterns from one stacked pattern to the next as in the first preferred embodiment, all the patterns are given the same inclining direction, and the connecting parts 4 and 5 are opened to be made tapping parts, from which tap lines are derived.

In such a configuration, each pattern layer is composed as an independent single-layer coil, and a plurality of single-layer coils can be freely connected whether in series or in parallel by varying the choice of the connecting part to be opened and the way in which the tap line is connected.

Furthermore, by combining the first and second adaptations, single-layer and multi-layer coils of any desired inductances can be freely connected to one another whether in series or in parallel.

As hitherto described, a cylindrical multi-layer coil using electroconductive flexible sheets can be composed by stacking pattern layers and insulating layers alternately into a multi-layer structure and varying alternately, from one layer to next, the inclining directions of the electroconductive patterns obliquely formed on the pattern layers.

Moreover, the inductance of the coil can be varied as desired because the connecting parts to establish continuity between the electroconductive patterns on the pattern layers can be formed in throughhole or land structures.

Furthermore, a plurality of single-layer coils can be freely connected whether in series or in parallel by unifying the inclining directions of the electroconductive patterns on the pattern layers.

Obviously, numerous additional modifications and variations of the present invention are possible in light of the above description. It is therefore to be understood that, within the scope of the appended claims, the invention may be practiced otherwise than as specifically described herein.

What is claimed is:

1. A multi-layer coil comprising:

a cylindrical laminated body including:

a plurality of cylindrical electroconductive flexible sheets having electroconductive patterns, and at least one cylindrical insulating sheet inserted between adjacent ones of said cylindrical electroconductive flexible sheets, said cylindrical electroconductive flexible sheets and said cylindrical insulating sheet being stacked alternately, wherein said electroconductive patterns are formed obliquely and in inclining directions, said inclining directions of said electroconductive patterns differing between said adjacent cylindrical electroconductive flexible sheets, and said insulating sheet including electroconductive connecting sections for connecting said electroconductive patterns of said adjacent cylindrical electroconductive flexible sheets.

2. A multi-layer coil as claimed in claim 1, wherein said electroconductive connecting sections comprise an electrical connection between said adjacent stacked electroconductive flexible sheets.

3. A multi-layer coil as claimed in claim 2, wherein said electroconductive connecting sections are connected to electroconductive tap lines.

* * * * *